US007845579B2

(12) United States Patent
Johnson

(10) Patent No.: US 7,845,579 B2
(45) **Date of Patent: *Dec. 7, 2010**

(54) LAMINAR FLOW WATER JET WITH ENERGETIC PULSE WAVE SEGMENTATION AND CONTROLLER

(76) Inventor: Bruce Johnson, 1342 S. Powerline Rd., Deerfield Beach, FL (US) 33442

( * ) Notice: Subject to any disclaimer, the term of this patent is extended or adjusted under 35 U.S.C. 154(b) by 403 days.

This patent is subject to a terminal disclaimer.

(21) Appl. No.: 11/280,392

(22) Filed: Nov. 17, 2005

(65) Prior Publication Data

US 2006/0102757 A1 May 18, 2006

Related U.S. Application Data

(60) Provisional application No. 60/628,226, filed on Nov. 17, 2004, provisional application No. 60/628,227, filed on Nov. 17, 2004.

(51) Int. Cl.
*B05B 17/08* (2006.01)
*F21S 8/00* (2006.01)

(52) U.S. Cl. ..... 239/17; 239/18; 239/589

(58) Field of Classification Search ..... 239/589, 239/589.1, 17, 18, 22, 23, 102.1, 102.2, 67, 239/69, 70, 71, 72; 362/96
See application file for complete search history.

(56) References Cited

U.S. PATENT DOCUMENTS 3,924,808 A 12/1975 Cooley
4,002,293 A 1/1977 Simmons
4,265,402 A 5/1981 Tsai
4,269,352 A * 5/1981 Przystawik ..... 239/17
4,889,283 A 12/1989 Fuller et al.
4,955,540 A 9/1990 Fuller et al.
5,078,320 A 1/1992 Fuller et al.
5,439,170 A 8/1995 Dach
5,802,750 A 9/1998 Fulmer
5,820,022 A * 10/1998 Fukano et al. ..... 239/17
5,979,791 A 11/1999 Kuykendal
6,076,741 A 6/2000 Dandrel
6,098,898 A * 8/2000 Storch ..... 239/69
6,276,612 B1 8/2001 Hall
6,427,927 B1 8/2002 Hall
6,611,114 B1 8/2003 Yen
6,641,056 B2 * 11/2003 Kuykendal et al. ..... 239/17
6,717,383 B1 4/2004 Brunt et al.
6,947,837 B2 * 9/2005 Fukushima et al. ..... 701/209
7,264,176 B2 * 9/2007 Johnson ..... 239/22

* cited by examiner

*Primary Examiner*—Davis Hwu
(74) *Attorney, Agent, or Firm*—Tangent Law Group, PLLC; Eric J. Weierstall, Esq.

(57) ABSTRACT

An apparatus for producing and controlling an energetic pulse wave in a laminar flow having an at least one water input and a housing with a water channel flowing therethrough. At least one jetting element for jetting a laminar flow tube from a laminar flow passing through the water channel. With at least one energetic pulse wave generating element generating an energetic pulse in a controlled fashion that travels into the laminar flow and selectively interrupts the laminarity therein.

31 Claims, 7 Drawing Sheets

LAMINAR FLOW WATER JET WITH ENERGETIC PULSE WAVE SEGMENTATION AND CONTROLLER

CROSS REFERENCE TO RELATED APPLICATIONS

This application claims benefit of the earlier filed U.S. Provisional Applications Nos. 60/628,226 and 60/628,227 both filed Nov. 17, 2004, which are incorporated herein by reference.

FIELD OF THE INVENTION

The invention relates to a water feature, specifically a controller and apparatus that imparts an energetic pulse wave into a laminar flow tube issuing from, for instance, a laminar flow water jet.

BACKGROUND OF THE INVENTION

It is often desired to utilize a fluid, such as water, as part of a display or attraction. Increasingly, the popularity of using water attractions as an integral part of domestic and commercial landscaping has moved architects and landscapers to push further and further into incorporating the decorative aspects of these water features into new building and sites. These features are incorporated through swimming pools, spas, ponds, lakes and other water features and sources found in the typical property. Various types of fountains adorn public and private plazas, parks, advertisements, and amusement parks.

To this end, recent interest and developments have been made in producing smooth, laminar flows of water which give the appearance of a solid glass or clear plastic rod in various water attractions, for instance, the fountain presentation in the Bellagio Hotel in Las Vegas or the Dancing Frogs attraction at the EPCOT center of Disney World, as described in U.S. Pat. No. 5,078,320 to Fuller, et al. These attractions incorporate laminar flow water jets. These devices jet water like a fountain, but the water has a minimum of turbulence in it that is the water is predominantly laminar. The water tension of the flow issuing forth provides the tubular shape. The water tension forms an outer jacket around the laminar flow, creating a laminar tube shape. This results in the smooth rod structure of the streams that are issued from the jets.

A first step in providing a laminar flow tube in a laminar flow jet is to produce a laminar water flow. These jet and fountain devices have used a wide variety of elements to instill laminarity into a water flow. Various attempts with a variety of elements have been made at reducing laminarity in a water stream. For example, U.S. Pat. No. 4,393,991 to Jeffras et al. discloses a sonic water jet nozzle which utilizes an elongated conical nozzle which includes fin-like members to reduce the turbulence of the water and to produce a laminar flow of water. U.S. Pat. No. 3,321,140 to Parkison et al. discloses an attachment for a faucet which utilizes a series of fins in a cylindrical nozzle for producing a laminar flow of water to reduce the splash on the bottom of a sink or tub. U.S. Pat. No. 3,730,440 to Parkison teaches a laminar flow spout which utilizes a plurality of independent nozzles arranged within a single spout which results in a plurality of streams having laminar flow characteristics. Systems like these and Applicant's co-pending application for a Laminar Flow Water Jet with Pliant Member provide the laminar flow tubes that are so desirable in water attractions.

In addition to providing a laminar flow, it is often desirable to provide a controlled interruption to the jet operation for the purposes of providing an artistic display. Again, referring back to the EPCOT display, the laminar flow jets function in a timed manner to provide an interesting display of water leaping from the frogs. There are various methods for producing columnarization or a controlled interruption of the laminar jet flow to produce discrete tubes. This is typically done by a mechanical diversion of the flow or a part of the flow for a controlled period of time.

Examples of this type of device can be seen in U.S. Pat. No. 4,889,283 which discloses a stream diverter that utilizes a diverter nozzle to split an output stream in a controlled fashion. This results in an interruption of the columnar length prior to its emergence from the device. Similarly, U.S. Pat. No. 5,802,750 discloses a spinning disk that interrupts the laminar flow after leaving the laminar flow water jet with a rotating wheel to simulate a jumping fish. However, these devices do not permit interruption of the laminarity without diversion of the flow jet or disruption of the column of the jet and, further, the devices do not provide a controllable energetic impulse or pulse to interrupt the jet.

Similarly, along these lines, in U.S. Pat. No. 6,717,383 a programmable fountain controller is shown for varying the flow rate of a fountain pump in a predetermined manner so as to generate dynamically changing flow patterns. These include an audio input amplifier that sends signals to vary the pumps in time to the input. This design however fails to provide a pulse wave or any similar disruption of the flow in a laminar flow water jet.

Although there are devices available that add vibratory or oscillatory pulses into a water stream, for instance in U.S. Pat. No. 3,924,808 that shows a shower head vibrator is attached to the resilient coupling provided between the water outlet pipe and the shower head that produces an oscillatory pattern in the flow, these devices do not provide the controlled interruption necessary to maintain laminarity in a laminar flow water column. Instead, these devices oscillate a turbulent flow in a random fashion, typically to produce a massaging pulse or oscillating pressure variation for massaging a user. They fail to provide for a laminar flow column, much less the interruption of the laminar flow column in a controlled fashion with an energetic pulse.

To date, no method has been able to selectively interrupt the laminarity within the laminar jet tube of a laminar water jet without significant visible disruption or diversion of the laminar jet. Moreover, no method to date has allowed for a level of variation in the interruption of the laminarity in the laminar jet tube that would allow for both discrete jet tube lengths, i.e. columnarization, as well as multiple segments within a tube or columnarized flow, i.e. discrete segmentation. Furthermore, no system can produce columnarization or segmentation and allow for discrete multiple color effects in the tubes or in columns. Thus a need exists for a controller and a method of controlling a laminar water tube or jet that allows for selective interruption of the laminarity within the tube with or without the discrete columnarization of the tube, especially a method that utilizes an energetic pulse.

SUMMARY OF THE INVENTION

An object of the invention is to provide a laminar flow water jet controller with the ability to input a controlled energetic pulse into the laminar flow water tube to discretely segment the tube, with or without discrete columnarization of the tube.

A further object of the invention is to provide a laminar flow water jet that is more compact and cost effective and has a wider variety of display features than the heretofore known laminar flow water jets.

Yet another object of the invention is to provide a water jet with a pulsed laminar flow column through a controller element that inputs an energetic wave into the laminar flow to disrupt and columnarize the flow.

A still further object of the invention is to provide a laminar flow water jet that is able to simultaneously accommodate pump surges and improve the laminar flow of water within the laminar flow water jet.

A still further object of the invention is to provide part of a laminar flow tube wherein a concentration of light is provided at a part of the laminar flow tube where a pulse wave is transmitted into the tube.

Yet another object of the invention is to provide a starburst effect of light at a part of a laminar flow tube where a pulse wave is transmitted into the laminar flow tube and disrupts the surface tension of the tube, allowing for reflection and reflection of the light and a resulting concentration of the light at the part of the tube.

The invention includes an apparatus and a method of operation.

The apparatus of the invention includes an apparatus having an at least one water input, a housing with a water channel flowing through, an at least one jetting element jetting a laminar flow tube from a laminar flow passing through the water channel, and an at least one energetic pulse wave generating element generating an energetic pulse in a controlled fashion that travels into the laminar flow and selectively interrupts the laminarity therein.

The apparatus further provides a controller in communication with the at least one energetic pulse wave generating element, the controller sending a command to the at least one energetic pulse wave generating element to send the energetic pulse into the laminar flow. The energetic pulse wave provides can provide a turbulent section within a continuous laminar flow tube. The energetic pulse wave can also provide a gap between discrete parts of the laminar flow water tube, creating discrete laminar flow columns.

The controller of the apparatus can receive an input from a timer. The controller can also receive an input from an audio or video input. The controller can also receive an input from a master controller. The controller can also send signals to at least one of an at least one audio system, video system, and a timer.

The apparatus may further provide an at least one lighting element. The at least one lighting element can light the laminar flow tube. The controller can send signals to the at least one lighting element. The at least one lighting element can change a color input into the laminar flow water tube based on instructions from the controller. The at least one lighting element can further include an at least one lighting tube and an at least one light source.

The apparatus can also provide a pliant member surrounding the water channel in the direction of flow of the water in the water channel, wherein the pliant member absorbs pump surges. A laminar flow disruptor can also be provided, the laminar flow disruptor being in communication with the controller, wherein the laminar flow disrupter causes interruption of the laminar flow tube issuing from the jet causing discrete laminar flow columns to issue. A light source can also be provided, with the light source communicating with the controller and lighting the discrete columns of laminar flow water. The discrete columns of laminar flow can also be interrupted by the energetic pulse wave such that a discrete column is discretely segmented and the light source provides light to each of the discrete segments. Each of the discrete segments can be lit by a different color.

The apparatus of the invention includes a laminar flow water jet, having an at least one water input admitting water into a housing, a housing conducting the water into a laminar flow water channel and ejecting the laminar flow water channel, a controller, and an at least one energetic pulse wave generating component, wherein the energetic pulse wave generating component sends an energetic pulse wave into the laminar flow water channel in a part of the laminar flow channel to interrupt the laminarity within the laminar flow at that part.

The water channel can be ejected as a laminar flow tube. The laminar flow water jet can also include an at least one lighting element. The at least one lighting element can further include a lighting tube and an at least one light source. The laminar flow tube can be colored by the lighting element.

The energetic pulse wave can provide a turbulent section within a continuous laminar flow tube. The energetic pulse wave can also provide a gap between discrete parts of the laminar flow water tube, creating discrete laminar flow columns.

The controller can receive an input from a timer. The controller can also receive an input from an audio or video input. The controller can also receive an input from a master controller. The controller can also send signals to at least one of an at least one audio system, video system, and a timer. The controller can further send signals to the at least one lighting element. The at least one lighting element can change a color input into the laminar flow water column based on instructions from the controller.

The laminar flow water jet can further provide a pliant member surrounding the water channel in the direction of flow of the water in the water channel, wherein the pliant member absorbs pump surges. A laminar flow disrupter can also be provided, the disruptor being in communication with the controller, wherein the laminar flow disruptor causes interruption of the laminar flow tube issuing from the housing, causing discrete laminar flow columns to issue therefrom. A light source can be provided, the light source communicating with the controller and lighting the discrete columns of laminar flow water. The discrete columns of laminar flow can be interrupted by the energetic pulse wave such that a discrete column is discretely segmented and the light source provides light to each of the discrete segments. Each of the discrete segments can be lit by a different color.

The apparatus of the invention also includes a water feature. The water feature can include water jets, water flows, waterfalls, and similar elements using a laminar flow. The water feature having a housing with a water channel, an at least one water input providing water to the water channel, an at least one laminar flow member to impart laminarity into the water in the water channel; an at least one issuing element, issuing a laminar flow from the housing; and an at least one energetic pulse wave generating member generating and transmitting an at least one energetic pulse wave into the laminar flow of the water channel in a controlled fashion to interrupt the laminarity in part of the laminar flow.

The method of the invention includes a method of providing multiple colors within a laminar flow of water, including the steps of providing a laminar flow of water, lighting the laminar flow of water, inputting an energetic pulse wave to disrupt the laminarity of the water flow at a specific part and provide discreet segmentation of the laminar flow of water, and changing the light color between different discrete segments in the laminar water flow. The method of providing multiple colors within a laminar flow further provides the method step of jetting the laminar flow of water into a laminar flow tube. The method of providing multiple colors can also include the method step of columnarizing the laminar flow tube, wherein discrete columns are created in laminar flow tube with the discrete segmentation therein.

The method of the invention also includes a method of operating a laminar flow water jet including the method steps of generating a laminar flow within a water channel in conjunction with a pump, monitoring a control input with a controller, sending an energetic pulse wave into the laminar flow upon a command from the controller, jetting the laminar water flow to form a laminar jet tube with controlled interruptions imparted by the energetic pulse wave to segment the laminar jet tube, and ejecting the laminar flow column.

The method of sending an energetic impulse upon a command can further include sending a command based on a change in or signal from a control input. The control input can be an at least one of a timer, an audio input and a video input. The method step of sending an energetic impulse can be accomplished via an energetic wave-generating component. The method step of sending an energetic impulse energetic pulse can occur after jetting the water tube. The method can further comprises the method step of changing color for each segment ejected.

The method of the invention includes also a method of producing segmentation in a laminar flow tube comprising the method steps of providing a laminar flow tube, generating an pulse wave, and transmitting the pulse wave into the laminar flow tube, wherein the surface tension in the tube is interrupted at a horizon of transmission. The method can further include the method step of lighting the laminar tube, wherein the step of lighting is coordinated with the step of transmitting the pulse wave into the laminar flow tube. The step of lighting can further include providing multiple wavelengths of light for each segment created by a pulse wave in the laminar flow tube.

Moreover, the above objects and advantages of the invention are illustrative, and not exhaustive, of those which can be achieved by the invention. Thus, these and other objects and advantages of the invention will be apparent from the description herein, both as embodied herein and as modified in view of any variations which will be apparent to those skilled in the art.

BRIEF DESCRIPTION OF THE DRAWINGS

Embodiments of the invention are explained in greater detail by way of the drawings, where the same reference numerals refer to the same features.

DETAILED DESCRIPTION OF THE INVENTION

Figure 1:
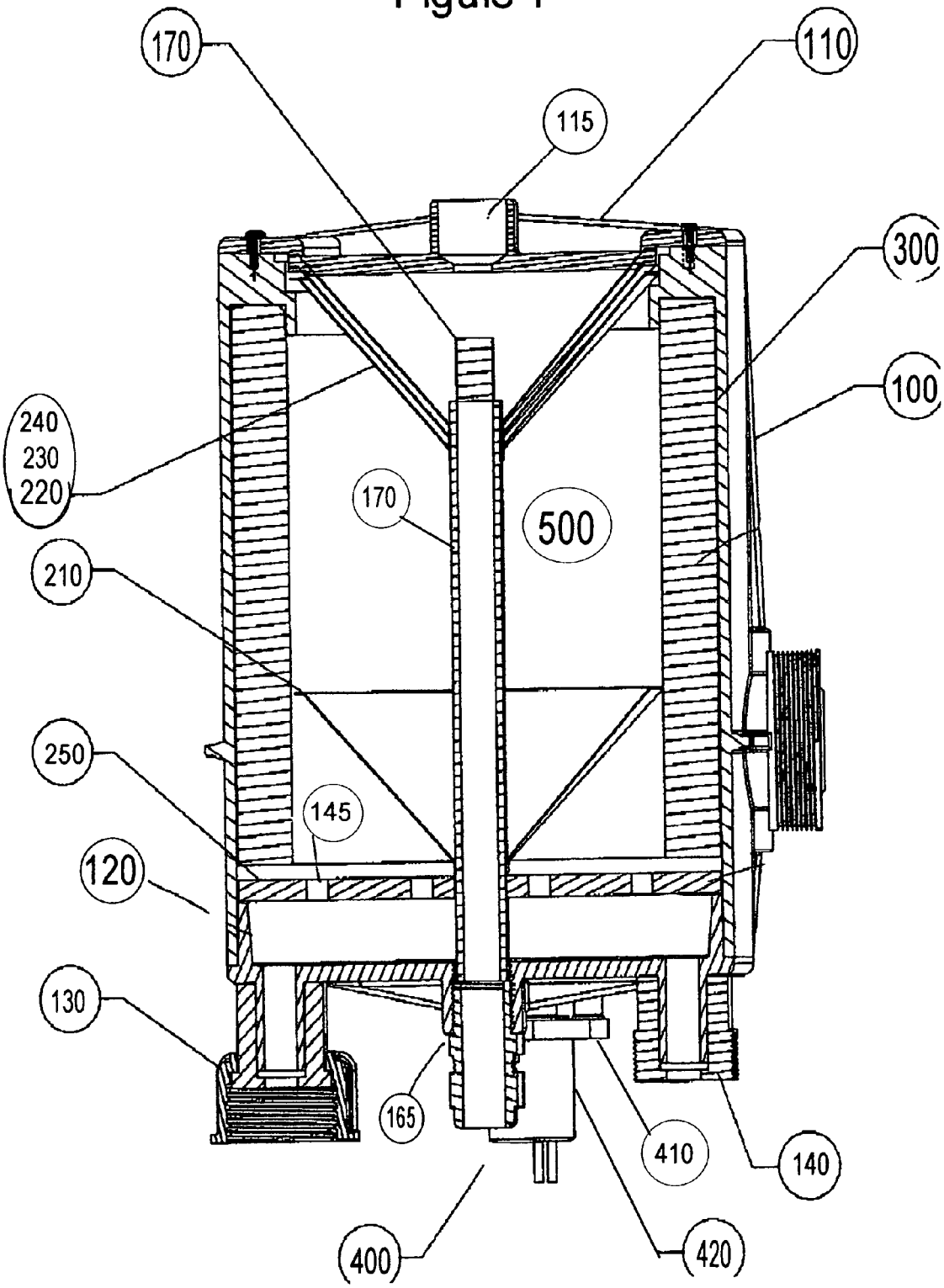
FIG. 1 shows a cross-sectional view of an exemplary embodiment of the instant invention.

FIG. 1 shows a cross sectional view of the exemplary embodiment of the instant invention. The exemplary embodiment of FIG. 1 comprises a housing 100, a housing top 110 with an at least one jet outlet 115 extending there through, and a housing base 120. Flowing into the housing base 120 is an at least one water input, in this instance a first water input 130 and a second water input 140. Within the housing 100 a laminar water flow channel 500 resides. Additionally, a lighting orifice 165 is provided and passes through the base plate to couple to a lighting tube 170. The lighting tube 170 extends into the laminar water flow channel 500 and through the housing 100 toward the at least one jet outlet 115. The lighting tube 170 is provided to apply lighting effects to the exiting water. The tube may utilize any appropriate lighting system, including but not limited to, conventional incandescent, halogen, fiber optic, LED, nano scale lighting devices or similar lighting systems. Furthermore, although the exemplary embodiment utilizes a light tube, any appropriate manner of focusing the lighting system may be used to illuminate the exiting water jet.

In the exemplary embodiment shown, internal to the housing 100 and the laminar water flow channel 500 flows from the plurality of inputs 130, 140, into an at least one baffle member 250 with a plurality of orifices 145 situated therein. Alternatively, the baffle member may be omitted from further exemplary embodiments. Above the plurality of inputs 130, 140 shown, an at least one filter member, in this case a plurality of filter members, is provided.

A first filter member 210 is provided in the laminar water flow channel 500 of the exemplary embodiment show in approximately the middle of the housing chamber. Variations in the placement, the positioning, the spacing, the shape, the size, and the number of members or screens can be provided alone or in conjunction with variations in sizes, density, construction, shapes, mesh size, screen gauge, and other variables to suit the particular design constraints of a further exemplary embodiment without departing from the spirit of the invention. Surrounding the interior of the housing 100 is an at least one elastomeric or pliant member 300 through which the laminar water flow channel 500 passes.

Pliant member 300 can be comprised of, for example, closed cell foam, rubber compounds, PVC and rubber compounds, air pillows, gel filled members, foam, or similar pliant materials. Pliant member 300 aids in damping vibrations within the water as it passes through the laminar water flow channel 500. Particularly pliant member 300 aids in mitigating pump surges and similar pressure variances as well as aiding in improving the laminarity in the water flow. The at least one pliant member 300 may also be incorporated, in combination with the pliant member shown around the housing or alone, into an at least one of the at least one filter members.

In the exemplary embodiment shown, in addition to the first filter 210 the at least one filter member includes a further series of three filter members 220, 230, 240 above the first filter member 210, which helps provide additional laminarity to the water as it flows towards the at least one jet outlet 115. The additional filter members 220, 230, 240 are also shown as conical in shape. However, it should be understood by one of ordinary skill in the art that the variations in geometry, number, and placement/spacing of the filter members are within the spirit of the invention. Additionally, as mentioned the at least one pliant member 300 can include an at least one pliant member mounted on or within an at least one of the at least one filter members. Further, it is readily evident to those of ordinary skill in the art that the controller 400 and the at least one pulse generating component can be included in existing laminar devices and the exemplary embodiment is only one example of such a system.

Figure 2:
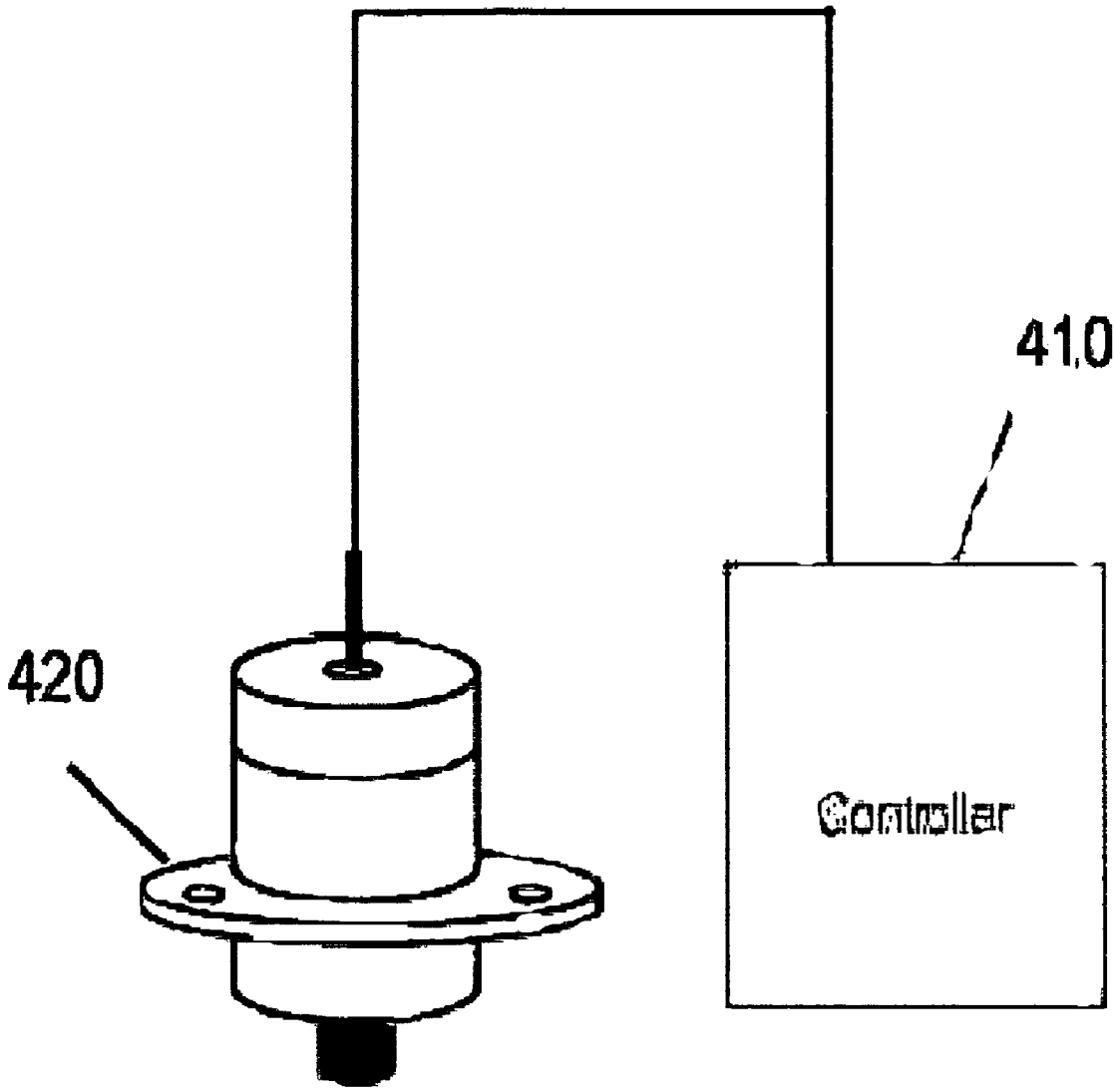
FIG. 2 shows a close up view of the solenoid and controller of the instant invention.

FIG. 2 shows a close up view of the solenoid and controller of the instant invention. In addition to the laminar flow jet 10, a control package 400 is provided on the exterior of the housing 100, as shown in FIG. 1. It would be understood by one of ordinary skill in the art that the controller 400 could be located on any laminar flow device on any appropriate location as the type of controller 400 and the type of pulse wave generating component are varied. As depicted in the exemplary embodiment the control package 400 is provided as a controller 400 and an at least one pulse wave generating component, in this instance a solenoid 420. The control package 400 provides a variable timed input to produce a controlled pressure variance or pulse wave within the laminar water flow channel 500.

This can be accomplished in any number of ways, in the exemplary embodiment shown, the solenoid 420 "thumps" or strikes the side(s) of the housing 100 to produce the pressure wave within the laminar water flow channel 500. Additional methods of providing the controlled variable pulse wave within the water flow may be utilized, for example the components of the package can be made to include digital electronic, analog electronic, electro-mechanical, or mechanical components suitable for producing a controlled input, such as a mechanical striking mechanism with a motor and clocks, an inline water wheel that driven by the incoming water flow, a return drip system that strikes the laminar water flow channel, sonic devices, electromechanical striking devices and similar components that can provide a metered pulse wave to interrupt the laminar jet as an pulse wave generator.

The control package 400 can comprise additional components. The controller may alternatively be comprised of all solid state components, all electrical components, all mechanical components, or any suitable combination therein to provide the necessary controlled resonance or "thump" to create the pressure wave on or in the laminar water flow channel 500. The components may be located in contact with the housing 100 at any position in, on, within, or without the housing that would allow the energetic wave to enter the water channel. Similarly, the components may be located discreetly away from the water jet, for instance if the system is utilizing an ultrasonic device, such that contact with the housing 100 is not necessary to input the energetic wave.

In the exemplary embodiment shown, the solenoid 420 is controlled by the microprocessor 410 and may be timed to suit a desired application. For instance, the microprocessor 410 may time the impulse from the solenoid 420 to music. Additionally, the controller 400 may be controlled by a master controller 7000, as further shown and described in relation to FIG. 5, which controls additional features or accessories in a coordinated water display. The controller may also include a wireless controller or connection, also as shown further in relation to FIG. 5.

Figure 3A:
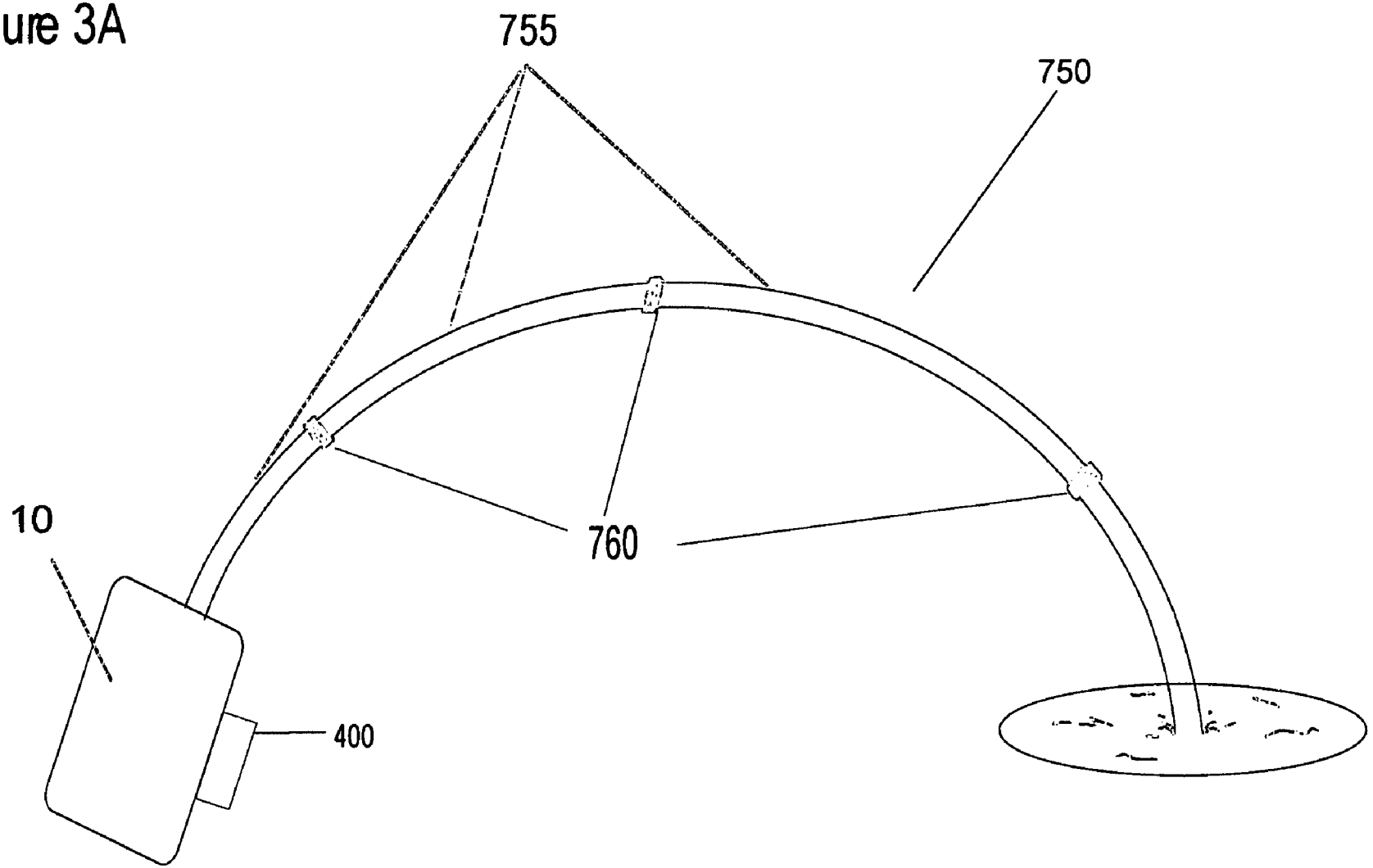
FIG. 3A shows an exemplary embodiment of the instant invention in operation with a segmented tubular flow.

FIG. 3A shows an exemplary embodiment of the instant invention in operation with a segmented tubular flow. The controller 400, through the pulse wave 760, interrupts the laminarity of the laminar water jet tube 750, producing discrete segments of laminar water jet tube 755 while maintaining the continuity of the tube. The timing of the pulses and the length of the jet 750 and the segments 755 can thus be controlled to provide a wide number of variations in the shape and size of the laminar jets. Additionally, the interruptions 760 in the laminar water tube issuing from the jet can result in a pleasing lighting effect, wherein each of the segments 755 provides a refractive and/or reflected concentration of light, similar to a starburst affect. This effect results from refraction and reflection, basically a concentration of light at the point of the pulse wave, that shines the light outward through an interruption 760 in the outer water jacket created by the water tension in forming the laminar flow water tube. This also allows for discrete multicolor segments as the point of concentration or interruption 760 acts as a boundary or interruption in the transmission of light within the tube, thereby permitting the use of different colors within each discrete segmentation 755.

Figure 3B:
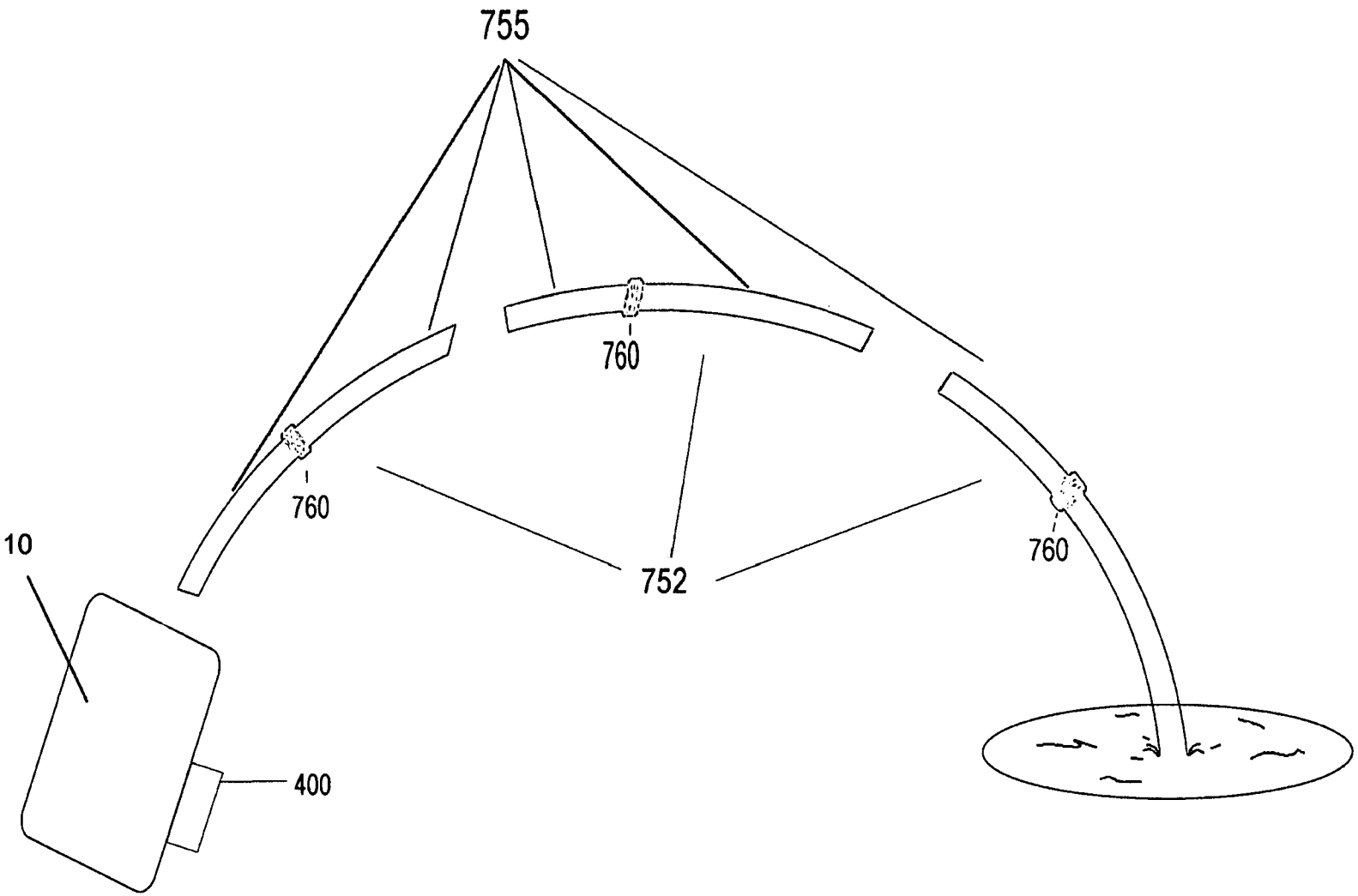
FIG. 3B shows an exemplary embodiment of the instant invention in operation with a segmented columnarized flow.

FIG. 3B shows an exemplary embodiment of the instant invention in operation with a segmented columnarized flow. The tube can also be columnarized by conventional methods, such as a diverter or disrupter, or may be columnarized by a prolonged pulse wave to separate the tube into discrete columns 752. The columns may then be further segmented into discrete segments 755 by the pulse wave 760. The diversion or columnarization can be coordinated with color changes to provide multiple color columns 752. Similarly, the segmentation created by the interruptions or pulse waves 760 can be coordinated to provide multiple color segments 755 within the discrete columns 752.

The control package 400, as previously discussed, provides a periodic, controlled protuberance or pulse within the water channel or the laminar flow. This protuberance is an energetic wave that passes through the laminar flow, through the jetting of the laminar flow, and continues as an interruption in the laminarity, producing a controlled "ripple" in the resulting laminar flow tube issuing from the jet. These periodic protuberances are produced to provide controlled interruptions, as seen in FIGS. 3A and 3B, in the laminarity of the laminar flow tube, in this instance as it exits the laminar water channel 500 at the jet outlet 115. This produces breaks, as shown, within the laminar out flow or laminar tube or column. In addition to the visual effect of breaking the laminar flow tube that is ejected, known as columnarization, in this case, as shown in FIG. 3B, the energetic wave can further segment the discrete columns. That is the instant invention can produce discrete pieces of laminar flow tube with or without visible gaps, as seen in FIGS. 3A and 3B. These interruptions in the laminar flow tube provide a particularly desirable effect when combined with the lighting from lighting tube 170.

The lighting tube 170 in the exemplary embodiment shown in FIG. 1 provides for illumination of the laminar flow tube as it is ejected. The illumination travels within the laminar flow tube like a fiber optic wire, reflecting within the tube and providing a pleasing colored glow. This light is interrupted by the pulse wave portions 760 of the instant invention, preventing light from going beyond the interruption and preventing light in a proceeding segment from going back down the tube to the preceding section. Thus, the lighting and lighting changes within the lighting tube 170 can be coordinated with the controller 400 to provide a seemingly multicolor laminar water jet. This can be provided as a solid or columnar laminar flow water jet. Thus, besides being able to provide the typical columnarization of the laminar flow water jet can be coordinated with segmentation within the columns to provide multicolored columns, as seen in FIG. 3B.

Figure 4:
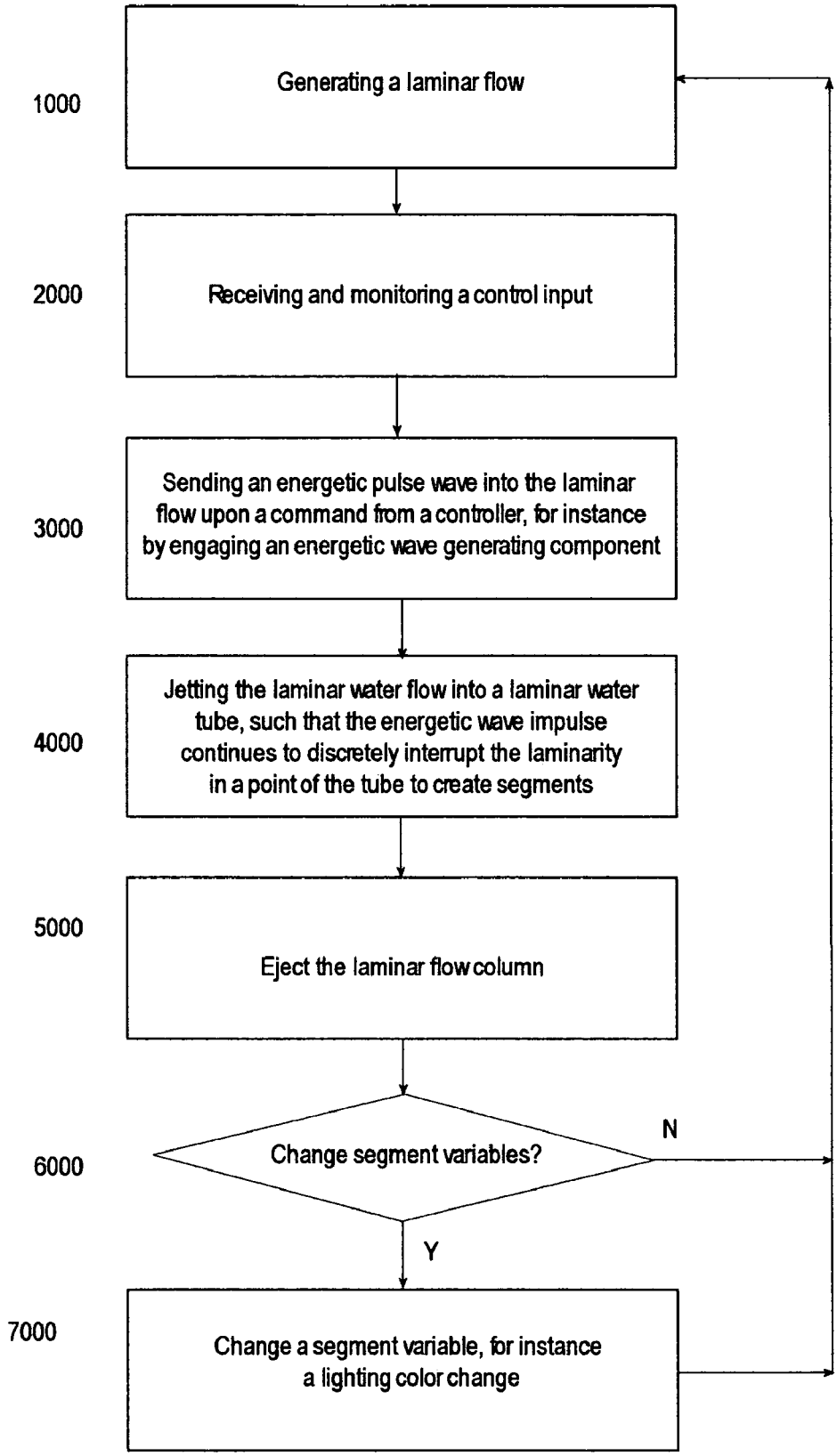
FIG. 4 shows a flow chart of an exemplary embodiment of the method of the instant invention.

FIG. 4 shows a flow chart of an exemplary embodiment of the method of the instant invention. The steps are provided in this order for this particular embodiment, the order of the steps may be varied to suit other exemplary embodiments without departing from the spirit of the invention. In the exemplary embodiment shown, the method of the instant invention is accomplished by generating a laminar flow within a water channel in conjunction with a pump in step 1000. In step 2000, a controller with a control input monitors the input. In step 3000, an energetic pulse is sent into the laminar flow upon a command from the controller, which can send the command based on a change or signal from the control input. The control input can be for instance a timer or other input. The controller can send the energetic wave via an energetic wave generating component, for instance a solenoid, which imparts the energetic pulse into the water channel to interrupt the laminarity within the water channel. It should however be noted that additional exemplary embodiments may place the input of the energetic pulse closer to the outlet of the laminar flow water jet or external to the laminar flow water jet and are within the spirit of the instant invention.

In step 4000, the laminar flow in the water channel is jetted to form a laminar jet column with the interruption imparted by the energetic wave generating component. This is done, for instance, through a jetting nozzle. The laminar jet column is then ejected in step 5000. Optionally, an additional step, in this instance step 6000 provides for a determination to be made regarding a segment variable. Although it may be accomplished at any time during the process, a change in a segment variable, such as a change in illumination may be conducted in coordination with a signal from the controller in step 7000. For instance, the light being shone into the column can be changed just after or just before the energetic pulse interruption. Alternatively, no change may be necessary and operations will continue from the beginning of the flow chart. The entire operation is repeated to suit the display.

Figure 5:
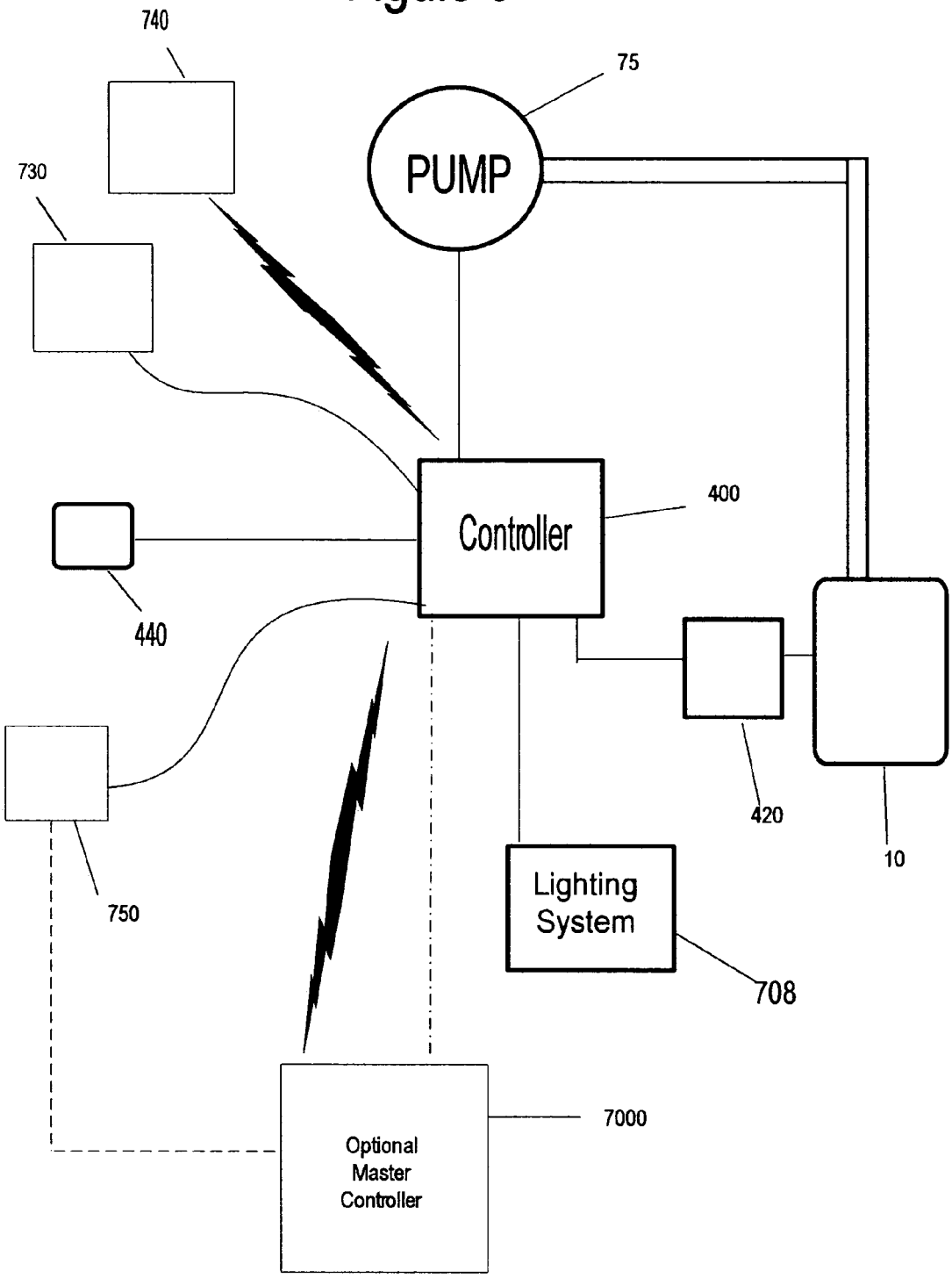
FIG. 5 shows a block schematic of the controller.

FIG. 5 shows a block schematic of the controller. The block schematic diagram shows a controller 400 with an at least one control input 440, for instance input from a timer or input from an audio translator or similar control input. The controller 400 can also be in communication with pump 75. An energetic pulse wave generating component 420 is provided, which can be for instance, but is not limited to, a solenoid or any of the devices previously enumerated. The energetic pulse wave generating component 420 generates the controlled pulse wave that creates the interruption, the "ripple", in the laminar flow within the water channel. The energy pulse generating component 420 communicates with the controller 400 to indicate its status. The controller 400 signals the energy pulse generating component 420 based on the input from the at least one control input 440. In addition to signaling the energy pulse wave generating component 420, the microprocessor controller 410 can additionally control lighting system(s) 700. The lighting system(s) 700 can be for instance be, but are not limited to, conventional incandescent, halogen, fiber optic, LED or similar lighting systems. Similarly, the microprocessor controller can also control an audio system 710 or other components 730, 740, 750 associated with an overall water feature presentation. These can comprise further water jets 730 or other water features, such as fountains, pop jets, waterfalls, and the like 740, 750. These additional components can be communicated with via hardwired lines or wirelessly, as shown.

In addition to controller 400, a master controller 7000 can optionally be provided, shown in shadow. The master controller 7000 can optionally (indicated by the dashed lines) communicate with the controller 400 to control the laminar flow water jet and, through controller 410 or through its own connections with the further components 730, 740, 750, additional components in a coordinated water display. This communication can be through hardwire connections or wirelessly.

Figure 6:
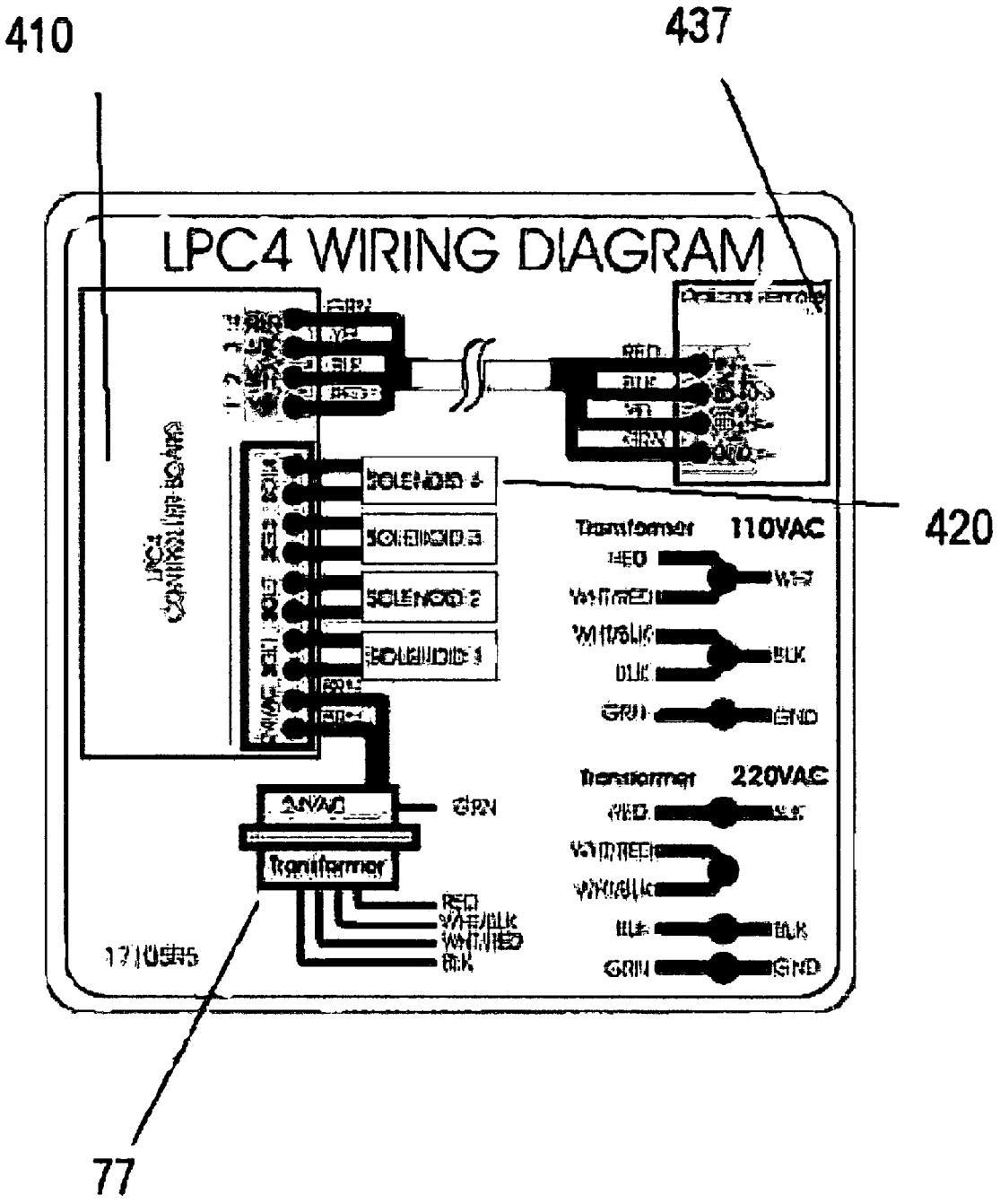
FIG. 6 shows an electrical wiring diagram of an exemplary embodiment of the controller.

FIG. 6 shows an electrical wiring diagram of an exemplary embodiment of the controller. The micro-processor 410 of controller 400 is in communication with at least one solenoid 420 with an optional remote control 437 communicating with it. The power input for the system is provided through transformer 77, which provides power to the controller. The transformer 77 steps the AC current down, for instance a 110 or 240 AC power input.

The embodiments, exemplary embodiments, and examples discussed herein are non-limiting examples of the invention and its components. The invention is described in detail with respect to exemplary embodiments, and it will now be apparent from the foregoing to those skilled in the art that changes and modifications may be made without departing from the invention in its broader aspects, and the invention, therefore, as defined in the claims is intended to cover all such changes and modifications as fall within the true spirit of the invention.

What is claimed is:

1. An apparatus comprising:

an at least one water input with water flowing therein;

a housing with a water channel, the housing creating a laminar flow in the water channel from the water flowing from the at least one water input and flowing through the housing;

an at least one lighting element;

an at least one jetting element jetting a laminar flow tube from the laminar flow passing through the water channel in the housing, the laminar flow tube being ejected from the housing as a glass-rod like laminar flow tube having a smoothed tubular surface and being lit by the at least one lighting element; and an at least one energetic pulse wave generating element generating an energetic pulse in a controlled fashion that travels into the laminar flow and selectively interrupts the tubular surface at a specific location on the glass-rod like laminar flow tube, thereby impairing the surface of the glass-rod like laminar flow tube and effecting the light passing within the glass-rod like laminar flow tube without disrupting the cohesion of the glass-rod like laminar flow tube.

2. The apparatus of claim 1, further comprising a controller in communication with the at least one energetic pulse wave generating element, the controller sending a command to the at least one energetic pulse wave generating element to send the energetic pulse into the glass-rod like laminar flow tube.

3. The apparatus of claim 2, wherein the controller receives an input from a timer.

4. The apparatus of claim 2, wherein the controller receives an input from an audio or video input.

5. The apparatus of claim 2, wherein the controller receives an input from a master controller.

6. The apparatus of claim 2, wherein the controller sends signals to at least one of an at least one audio system, video system, and a timer.

7. The apparatus of claim 2, further comprising a laminar flow jet disruptor in communication with the controller, wherein the laminar flow jet disruptor causes interruption of the glass-rod like laminar flow tube issuing from the jet causing discrete glass-rod like laminar flow columns to issue instead.

8. The apparatus of claim 7, wherein the at least one lighting element communicates with the controller and lights the discrete glass-rod like laminar flaw columns.

9. The apparatus of claim 8, wherein the discrete glass-rod like laminar flow columns are interrupted by the energetic pulse wave such that the discrete column is distinctly segmented and the light source provides light to each of the distinct segments.

10. The apparatus of claim 9, wherein each of the distinct segments is lit by a different color.

11. The apparatus of claim 1, wherein the energetic pulse wave provides a turbulent section within a continuous glass-rod like laminar flow tube.

12. The apparatus of claim 1, wherein the energetic pulse wave provides a gap between discrete parts of the jetted, glass-rod like laminar flow water tube, creating discrete laminar flow tubular columns.

13. The apparatus of claim 1, wherein the controller sends signals to the at least one lighting element.

14. The apparatus of claim 13, wherein the at least one lighting element changes a color input into the laminar flow water tube based on instructions from the controller.

15. The apparatus of claim 14, wherein the at least one lighting element further comprises an at least one lighting tube and an at least one light source.

16. A laminar flow water jet, comprising:

an at least one water input admitting water into a housing;

an at least one lighting element;

a housing moving the water into a laminar flow water channel, smoothing and adding laminarity to the water within the laminar flow water channel and ejecting the laminar flow water channel as a laminar flow tube having a cohesive, generally smooth surface and a glass-rod like appearance and being lit by the at least one lighting element;

a controller; and an at least one energetic pulse wave generating component, wherein the energetic pulse wave generating component sends an energetic pulse wave into the laminar flow water channel and into a part of the laminar flow tube to interrupt the laminarity within the laminar flow tube at that part, creating an aberration in the generally smooth surface and in so doing changing the light transmission characteristics along the laminar flow tube.

17. The laminar flow water jet of claim 16, the at least one lighting element further comprises a lighting tube and an at least one light source.

18. The laminar flow water jet of claim 17, wherein the laminar flow tube is colored by the lighting element.

19. The laminar flow water jet of claim 18, wherein the energetic pulse wave provides a turbulent section within a continuous laminar flow tube.

20. The laminar flow water jet of claim 18, wherein the energetic pulse wave provides a gap between discrete parts of the laminar flow water tube, creating discrete laminar flow columns.

21. The laminar flow water jet of claim 16, wherein the controller receives an input from a timer.

22. The laminar flow water jet of claim 16, wherein the controller receives an input from a audio or video input.

23. The apparatus of claim 16, wherein the controller receives an input from a master controller.

24. The apparatus of claim 16, wherein the controller sends signals to at least one of an at least one audio system, video system, and a timer.

25. The laminar flow water jet of claim 16, wherein the controller sends signals to the at least one lighting element.

26. The laminar flow water jet of claim 25, wherein the at least one lighting element changes a color input into the laminar flow water column based on instructions from the controller.

27. The laminar flow water jet of claim 16, further comprising a pliant member surrounding the water channel in the direction of flow of the water in the water channel, wherein the pliant member absorbs pump surges.

28. The laminar flow water jet of claim 16, further comprising a laminar flow disruptor in communication with the controller, wherein the laminar flow disruptor causes interruption of the laminar flow tube issuing from the housing, causing discrete laminar flow columns to issue therefrom.

29. The laminar flow water jet of claim 28, further comprising a light source communicating with the controller and lighting the discrete columns of laminar flow water.

30. The laminar flow water jet of claim 29, wherein the discrete columns of laminar flow are interrupted by the energetic pulse wave such that a discrete column is discretely segmented and the light source provides light to each of the discrete segments.

31. The laminar flow water jet of claim 30, wherein each of the discrete segments is lit by a different color.

* * * * *